US008430489B2

(12) United States Patent
Platt et al.

(10) Patent No.: US 8,430,489 B2
(45) **Date of Patent: *Apr. 30, 2013**

(54) METHOD AND APPARATUS FOR MELT CESSATION TO LIMIT INK FLOW AND INK STICK DEFORMATION

(75) Inventors: David P. Platt, Newberg, OR (US); Chad D. Freitag, Portland, OR (US); Isaac S. Frazier, Portland, OR (US); Jason Woebkenberg, Lake Oswego, OR (US); Brent R. Jones, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/466,707

(22) Filed: May 8, 2012

(65) Prior Publication Data

US 2012/0218327 A1 Aug. 30, 2012

Related U.S. Application Data

(62) Division of application No. 12/411,669, filed on Mar. 26, 2009, now Pat. No. 8,192,004.

(51) Int. Cl.
*B41J 2/175* (2006.01)

(52) U.S. Cl.
USPC ..... 347/88; 347/7

(58) Field of Classification Search ..... 347/19, 347/88, 99, 7, 17
See application file for complete search history.

(56) References Cited

U.S. PATENT DOCUMENTS

| | | | |
|---|---|---|---|
| 6,210,629 | B1 | 4/2001 | Bruckner et al. |
| 6,648,435 | B1 | 11/2003 | Jones |
| 6,981,754 | B2 | 1/2006 | Godil et al. |
| 7,011,399 | B2 | 3/2006 | Godil et al. |
| 7,147,313 | B2 | 12/2006 | Godil et al. |
| 7,458,669 | B2 | 12/2008 | Jones et al. |

*Primary Examiner* — Lam S Nguyen
(74) *Attorney, Agent, or Firm* — Maginot, Moore & Beck, LLP

(57) ABSTRACT

A system controls application of heat with a melt plate to an ink stick in a solid ink imaging device. The system includes a melt plate, a heater configured to heat the melt plate to a temperature sufficient to melt solid ink, a feed channel configured to direct solid ink sticks towards the melt plate to enable a leading edge of a solid ink stick to be melted by the heated melt plate, and a controller configured to separate the heater and the leading edge of the ink stick by a distance that arrest melting of the ink stick.

12 Claims, 13 Drawing Sheets

METHOD AND APPARATUS FOR MELT CESSATION TO LIMIT INK FLOW AND INK STICK DEFORMATION

CLAIM OF PRIORITY

This application is a divisional application and claims priority to U.S. patent application Ser. No. 12/411,669, which was filed on Mar. 26, 2009, and is entitled "Method And Apparatus For Melt Cessation To Limit Ink Flow And Ink Stick Deformation." The '669 application issued as U.S. Pat. No. 8,192,004 on Jun. 5, 2012.

TECHNICAL FIELD

The devices and methods disclosed below generally relate to solid ink imaging devices, and, more particularly, to solid ink handling systems for imaging devices that deliver solid ink sticks along an ink stick channel to a melting device in a solid ink printer.

BACKGROUND

Solid ink or phase change ink printers conventionally receive ink in a solid form, either as pellets or as ink sticks. The solid ink pellets or ink sticks are typically inserted through an insertion opening of an ink loader for the printer, and the ink sticks are pushed or slid along the feed channel by a feed mechanism and/or gravity toward a melt plate in the heater assembly. The melt plate melts the solid ink impinging on the plate into a liquid that is delivered to an ink reservoir which maintains the ink in melted form for delivery to a print head for jetting onto a recording medium.

One difficulty faced during operation of solid ink printers is the heat in the thermal mass of the melt plate following the termination of power to the melt plate. This heat may be sufficient to melt an appreciable amount of additional ink. If the reservoir supplied by the melt plate was full or nearly full when the power was terminated, the additional melted ink may cause the reservoir to overfill. Another issue arising from the heat in the melt plate being dissipated after power termination is the possibility of ink stick deformation. The portion of the ink stick against the melt plate may not receive enough heat to develop molten flow, but may merely deform, such as by spreading near the melt front. In some cases, this deformation may subsequently result in melt flow at the sides or the ink stick being directed through the feed channel in an off-axis direction that may impact the efficiency of ink stick melting once power is re-coupled to the melt plate. Therefore, interaction of an ink stick and a melt plate as the melt plate cools may impact operation of a solid ink stick printer.

SUMMARY

A system has been developed that controls application of heat with a melt plate to an ink stick in a solid ink imaging device. The system includes a melt plate, a heater configured to heat the melt plate to a temperature sufficient to melt solid ink, a feed channel configured to direct solid ink sticks towards the melt plate to enable a leading edge of a solid ink stick to be melted by the heated melt plate, and a controller configured to separate the heater and the leading edge of the ink stick by a distance that arrests melting of the solid ink stick.

A method has also been developed that controls application of heat with a melt plate to an ink stick in a solid ink imaging device. The method includes monitoring termination of electrical power to a heater that heats a melt plate for melting solid ink sticks in a solid ink printer, and separating the heater and the leading edge of the ink stick by a distance that arrests melting of the ink stick.

BRIEF DESCRIPTION OF THE DRAWINGS

The foregoing aspects and other features of the present disclosure are explained in the following description, taken in connection with the accompanying drawings.

DETAILED DESCRIPTION

The term "printer" as used herein refers, for example, to reproduction devices in general, such as printers, facsimile machines, copiers, and related multi-function products. While the specification focuses on a system that controls the delivery of heat to a leading edge of a solid ink stick in a feed channel, the transport system may be used with any solid ink image generating device. Solid ink may be called or referred to as ink, ink sticks, or sticks.

Figure 1:
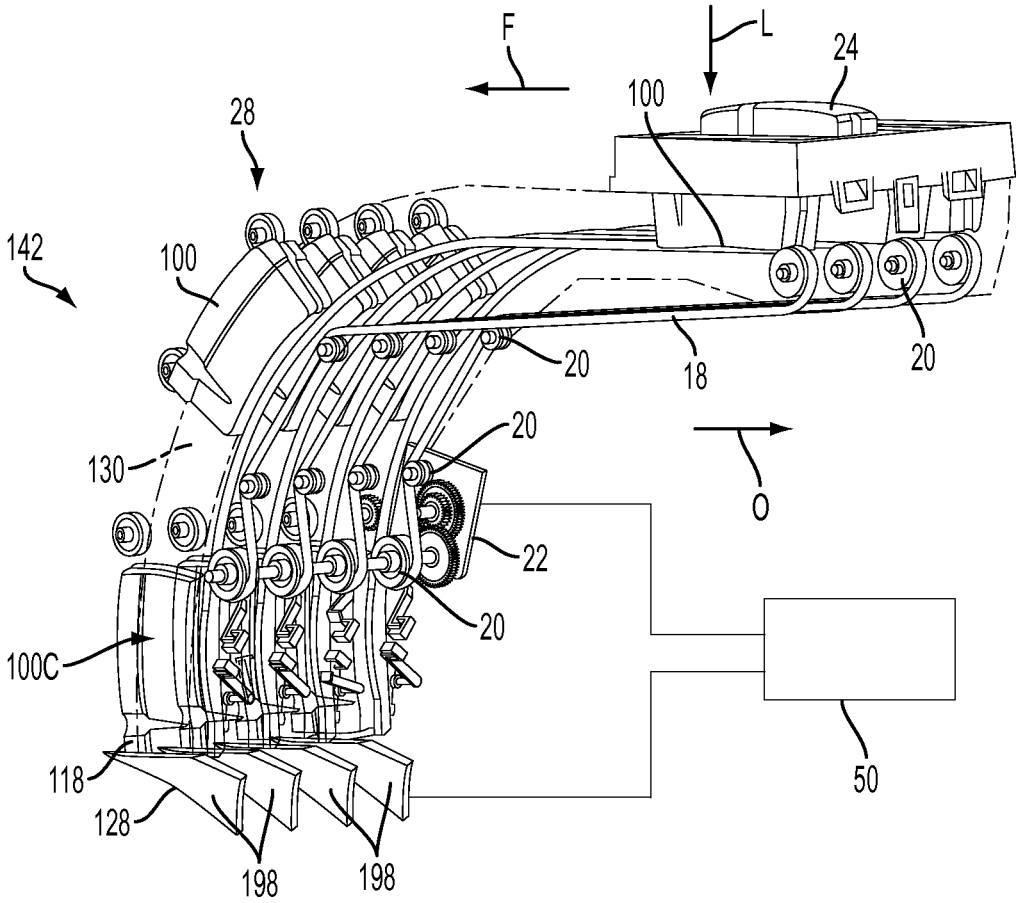
FIG. 1 is a schematic diagram of a phase change ink handling system for use in an image producing machine.

A loading system that includes a mechanized drive and a gravity fed section is shown in FIG. 1. As shown in the figure, the ink delivery system 142 includes a plurality of feed channels 130 having curved sections 28. The feed channels 130 have constraining surface 174 which may have rollers or low friction coatings to assist motion of the ink sticks. The ink delivery system 142 includes an endless belt 18 mounted around pulleys 20 at least some of which are driven by a motor and gear train 22 or the like. An ink stick 100 placed in the loading area 24 engages the belt 18 and is carried along the feed channel 130 in response to the pulleys 20 being driven. After transitioning through the curve 28, the ink stick begins a fall towards a melting assembly 128. As shown in FIG. 1, a stack of ink sticks 100 may develop in the gravity fed portion of the feed channel 130. The weight of these sticks help urge the bottommost stick against the melting assembly 128 and the melt plates 198 for more efficient melting.

As shown in FIG. 1, the ink delivery system 142 may include a plurality of channels, or chutes, e.g., feed channel 130. A separate feed channel 130 is utilized for each of four different colors of solid ink, i.e., cyan, magenta, yellow, and black (CMYK). The four colors referenced are typical but a printer may use any practical number of unique colors. The ink delivery system 142 includes loading area 24 that provide access to the feed channels 130 of the ink delivery system 142. The feed channel receives ink sticks inserted through the solid ink loading areas 24 in an insertion direction L. In the embodiment of FIG. 1, the insertion direction L is substantially vertical, i.e., parallel to the direction of gravitational force. The feed channel 130 is configured to transport ink sticks in a feed direction F from the loading area 24 to the melting assembly 128, according to the partially arcuate path 28 of the feed channel 130. In the embodiment of FIG. 1, the insertion and feed directions L, F are different. For example, ink sticks 100 may be inserted in the vertical insertion direction L and then moved in a horizontally oriented feed direction F, at least initially. In an alternative embodiment, the feed channels and loading areas or insertion openings may be oriented such that the insertion and feed directions L and F are substantially parallel, perpendicular or any relative angle with or without transitions in feed direction intermediate the insertion and melt ends.

The feed channel 130 has sufficient longitudinal length so that multiple ink sticks may be sequentially positioned in the feed channel. The feed channel 130 for each ink color retains and guides ink sticks 100 so that the sticks progress along a desired feed path. The feed channel 130 may define any suitable path for delivering ink sticks from the loading areas 24 to the melting assembly 128. For example, feed channels may be linear in some sections and non-linear in other sections. Furthermore, the feed channel 130 may be disposed horizontally in some sections and vertically in other sections. In the embodiment of FIG. 1, the feed channel 130 is initially horizontally oriented and is curved downwardly toward the melting assembly 128 such that ink sticks are fed into the melting assembly in a vertical orientation. In the embodiment shown in FIG. 1 the downwardly vertical orientation of the feed channel 130 at the melting assembly 128 allows gravity to provide the primary force for transporting ink sticks toward the melting assembly 128. Alternatively, the movement of the ink sticks 100 and the force by which the ink sticks 100 make contact with the melting assembly may be influenced by the drive mechanism 142.

Power to the melting assembly 128 is cycled to control the amount of ink that is melted from the ink stick 100. A controller 50 determines when electrical power to the heater is terminated. Such heater power may be energized and/or terminated by the controller 50 or another on board processor so determining or monitoring may consist of issuing or detecting a heater power status change. In response to the termination of power, the controller 50 causes the heat source to separate the leading edge 118 of the leading ink stick 100C from the melt plate(s) 198 by a distance that arrests further melting of the leading edge 118 of the ink stick 100. The significantly limited post heater turn off melt mass with this or any described method may be between zero and thirty percent of the mass of an equivalent system without utilizing the current teachings to abate or arrest melting ink after the heater shutdown process. Thus the terms arrest or abate are not intended to infer instantaneous stoppage. In one type of prior art system, the melted ink mass occurring after powering down the melt plate heater is about 1.5 grams. Utilizing the current teachings on the prior art systems, the post heater turn off melt mass would be about 0.45 grams or less, the equivalent of a measurable but comparably insignificant melt volume.

The controller 50 includes memory storage for data and programmed instructions. The controller may be implemented with one or more general or specialized programmable processors that execute programmed instructions. The instructions and data required to perform the programmed functions may be stored in memory associated with the processors or controllers. The processors, their memories, and interface circuitry configure a controller to perform functions, such as the melt plate heater monitoring and melt plate and ink stick separation functions, which are described more fully below. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

In order to separate the leading edge of the leading ink stick and the heat source by an appropriate distance in response to power to the heat source being terminated, several approaches may be adopted according to the current teachings. In a first group of embodiments the leading ink stick and the heat source are actively separated by retracting the leading ink stick from a stationary heat source. In one embodiment, suggested by the configuration of FIG. 1, a conveyor can be used. The endless belt 18 is proximate to the feed channel 130 and urges the ink sticks through the feed channels and towards the melting assembly 128. A controller that is coupled to the endless belt 18 controls the forward motion of the endless belt 18 in the F direction. With a vertical gravity-urged path to the melt plate, as in the configuration shown in FIG. 1, the endless belt 18 may extend further down and be augmented with a complementary conveyor on the opposite side of the ink stick in a squeezing fashion so that the ink stick can effectively be moved in a direction opposed to gravity. This would not be required with a feed path in a more horizontal orientation. In an alternative embodiment where the endless belt 18 extends to near the end of the feed channel 130, the controller can reverse the endless belt 18 motion in the F direction, in order to separate the leading edge 118 of the leading ink stick 100C away from the melting assembly.

Figure 2:
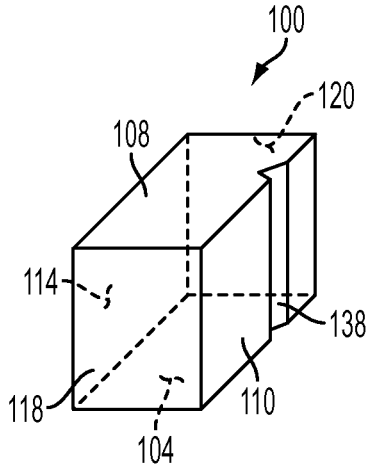
FIG. 2 is a perspective view of an embodiment of a solid ink stick for use in an image producing machine

Referring to FIG. 2, an exemplary embodiment of a solid ink stick 100 is shown. The exemplary ink stick 100 has a bottom surface 104 and a top surface 108. In the embodiment shown in FIG. 2, the bottom surface 104 and top surface 108 are substantially flat and parallel, although they can take on other contours and relative relationships as discussed below. The ink stick body also has a plurality of side extremities, such as lateral side surfaces 110, 114 and end surfaces 118, 120. The side surfaces 110 and 114 are substantially parallel one another, and are substantially perpendicular to the top and bottom surfaces 108, 104. The end surfaces 118, 120 are also substantially parallel one another, and substantially perpendicular to the top and bottom surfaces, and to the lateral side surfaces. However, the surfaces of the ink stick body need not be flat, nor need they be parallel or perpendicular one another. One of the end surfaces 118 forms a leading edge. The ink stick body may be formed by pour molding, injection molding, compression molding, or other known techniques. To aid in the correct insertion of the ink stick 100, the ink stick 100 may be provided with key contours 138. The key contour 138, shown in FIG. 2, is a vertical recess or notch formed in side surface 110 of the ink stick 100. Key contours may comprise surface features formed into the ink stick 100 such as protrusions and/or indentations that are located in different positions on an ink stick for interacting with complementarily shaped and positioned key elements in the insertion openings of the printer. For example, each of four different colors of solid ink, e.g., cyan, magenta, yellow, and black (CMYK) used in the printer may have different key contours. These different key contours prevent inserting an ink stick of one color into an insertion point configured to accept ink sticks of another color. Other features may be included, such as model/series keys and sensor features.

Figure 3:
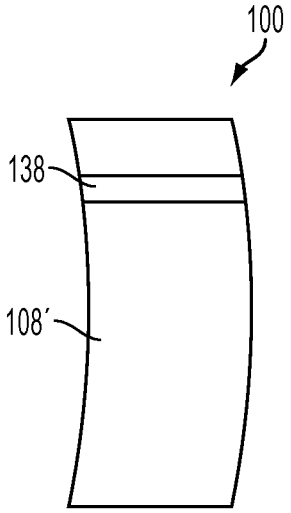
FIG. 3 is a side view of an alternative embodiment of a solid ink stick for use in an image production machine.

Referring to FIG. 3, an alternative embodiment of the ink stick 100 is shown. In this embodiment the bottom surface 108' is curved to accommodate an arcuate path along which the ink stick 100 travels. Travel of the ink stick 100 along such a path is discussed below.

Figure 4:
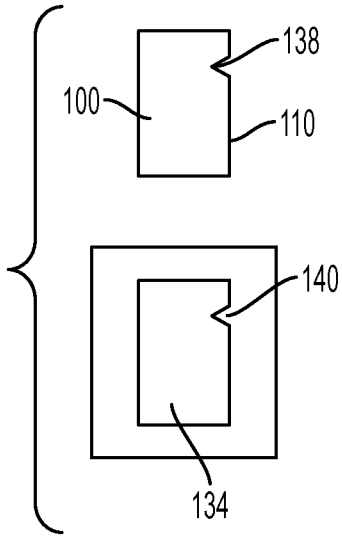
FIG. 4 is schematic diagram of interface between a keyed contour of an ink stick and keyed opening of the ink handling system of FIG. 1.

Referring to FIG. 4, an interface between ink stick 100 and ink stick insertion opening 134 is shown. The ink stick 100 includes an insertion key contour 138. The insertion key contour 138 is configured to interact with keyed insertion opening 134 of the ink delivery system 124 to admit or block insertion of the ink sticks through the insertion opening 134. A key element 140 is included on the perimeter of the keyed openings 134 to complement the key contour 138 formed in the side surface 110 of the ink stick 100. The interface between key element 140 and keyed contour 138 prevents insertion of an ink stick with a different keyed contour at the keyed opening 134.

Figure 5:
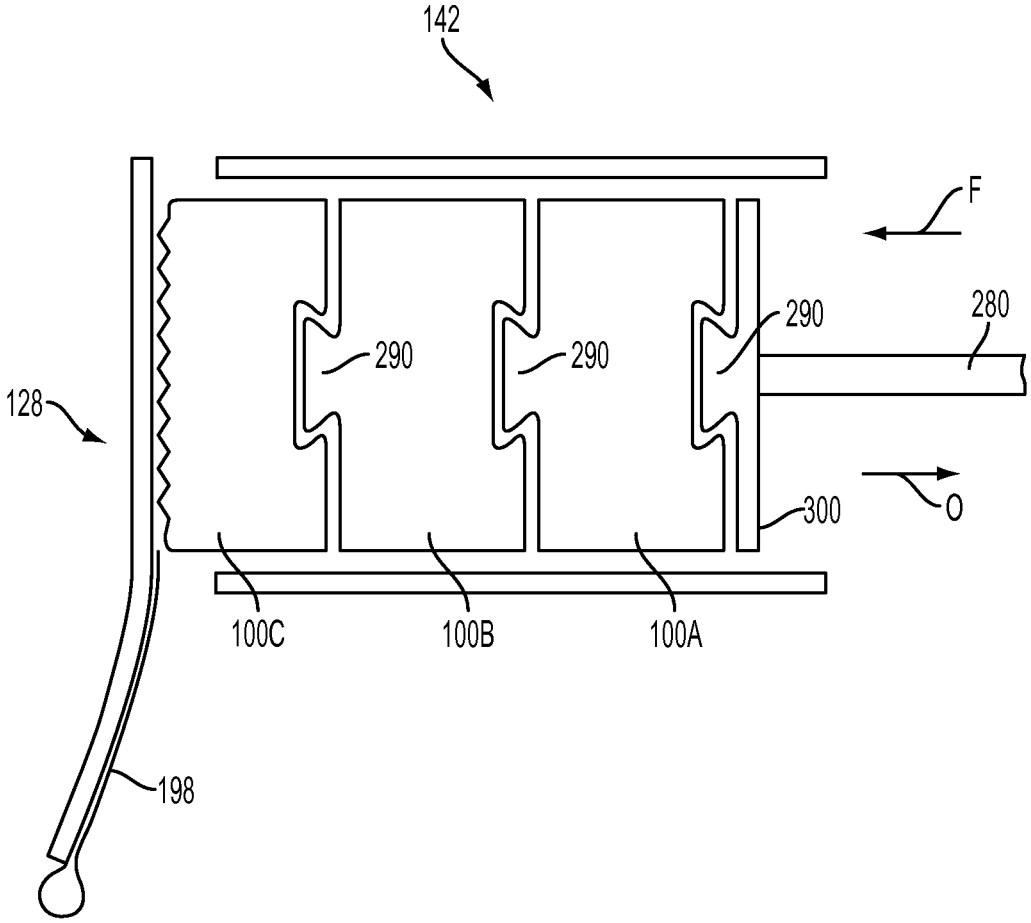
FIG. 5 is a schematic diagram of interlocked ink sticks in a phase change ink handling assembly according to a group of embodiments.

Similar drive mechanisms as that shown in FIG. 1 capable of forward and reverse actions can be used in relationship with other embodiments. In one embodiment, ink sticks with interlocking features may be beneficial. Referring to FIG. 5, an exemplary embodiment is shown where ink sticks 100A, 100B and 100C are interlocked and thereby form a chain of ink sticks that are disposed in the drive mechanism 142. In this embodiment the drive mechanism 142 may be acting on the first ink stick 100A of the chain farthest away from the melting assembly 128 by way of a press rod 280 and a locking interface 300. The drive mechanism 142 in this embodiment uses a solid link interface configuration, connected to a rod 280. The rod 280 is attached to an actuating apparatus (not shown). Known actuating apparatuses include a piston assembly, a motor coupled to a rack and pinion assembly, or other known actuating apparatuses that can achieve the same result of applying a bi-directional linear force on the locking interface 300 and cause axial movements of the locking interface 300. The locking interface 300 engages the first ink stick 100A of the chain by way of interlocking features 290 disposed on the locking interface 300 and the plurality of ink sticks. While the melting assembly is powered on, the drive mechanism 142 forces the locking interface 300 in the F direction. In order to reverse the leading ink stick 100C from the melting assembly 128, the drive mechanism 142 reverses and thereby forces the locking interface 300 in the O direction, causing a retraction of the leading ink stick 100C when the heater is powered off. The amount of separation between the leading ink stick and the heater necessary to prevent or limit further melting of the ink stick when the heater is powered off depends on several factors. Among these factors are the thermal mass of the melting assembly and the melting temperature of the ink stick. In one embodiment, the drive mechanism 142 needs to be reversed by about 1.0 mm to provide sufficient separation between the leading ink stick and the heater to prevent or limit further melting of the leading ink stick when the heater is powered off. Actual travel requirements are influenced by the number of ink sticks in the column and the clearance of the interlocking features.

Figure 6:
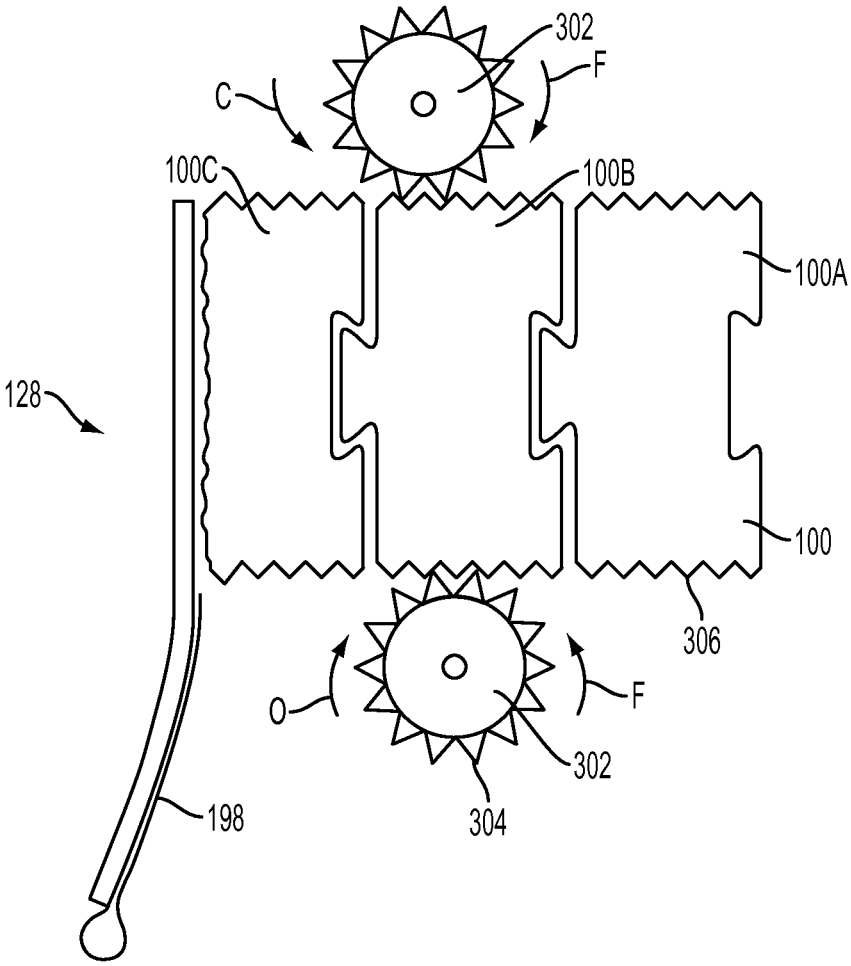
FIG. 6 is a schematic diagram of interlocked ink sticks with geared surfaces in a phase change ink handling assembly according to a group of embodiments.

In another embodiment, the ink sticks may have cogged surfaces, preferably, on two complementary surfaces, e.g., top and bottom surfaces 108 and 104. An example of this embodiment is shown in FIG. 6. Using a cogged or geared interface eliminates the need for the end to end locking interface 300. Gears 302 having teeth 304 engage teeth 306 disposed on ink sticks 100. While the melting assembly is powered on, the gears 302 turn in the F direction exerting a downward force on the ink sticks, causing the leading ink stick 100C to engage the melting assembly 128. The gears 302 are turned by motors, e.g., direct current motors and may drive through a friction slip coupling. In order to reverse the leading ink stick 100C from the melting assembly 128, gears 302 reverse in the O direction, causing a retraction of the leading ink stick 100C when the heater is powered off. Although interlocked ink sticks are shown in FIG. 6, using the geared interface may allow elimination of the interlocking interface all together. This can be accomplished by engaging the leading ink stick 100C with the gear(s) 302. In this case, the column of ink sticks stacked behind the leading ink stick 100C would be urged to the melt plate by gravity, a spring loaded plunger, conveyer or other appropriate means.

Figure 7:
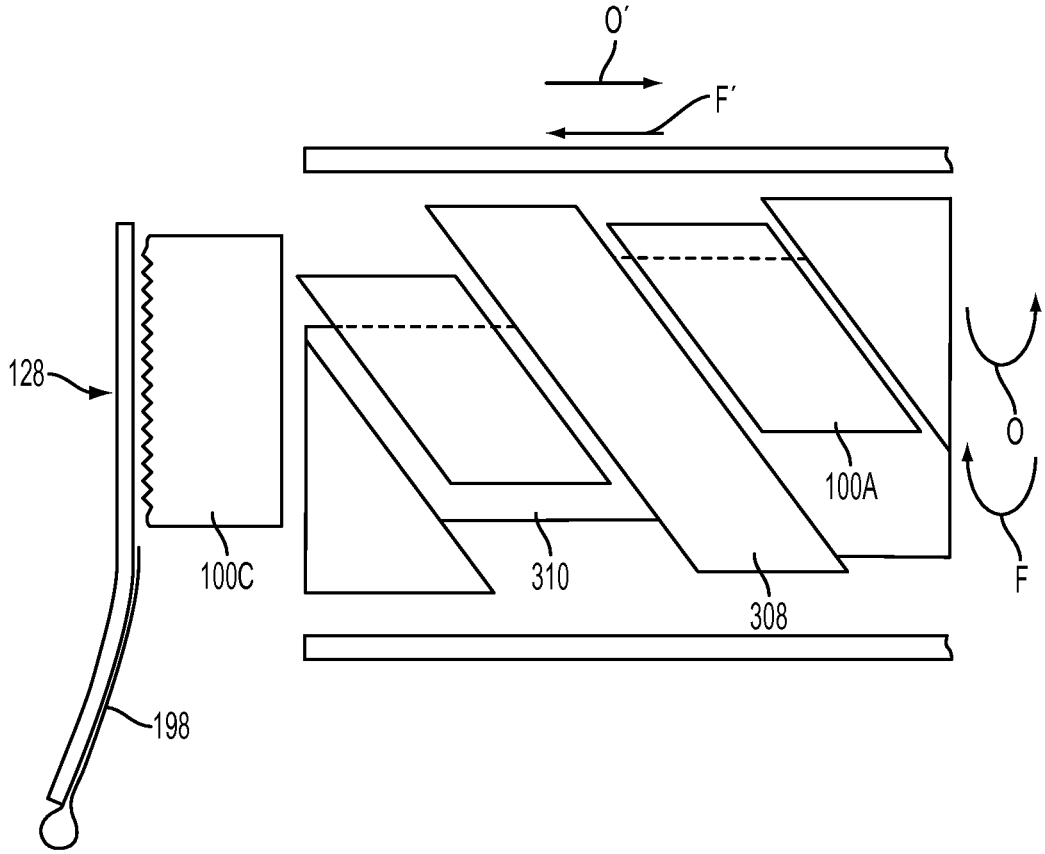
FIG. 7 is a schematic diagram of an auger-like drive mechanism in a phase change ink handling assembly according to a group of embodiments.

In another embodiment, the ink sticks may be retracted by an auger-like conveyor assembly. This embodiment is shown in FIG. 7. Any means of feeding ink sticks toward the melt end F', may be employed, including gravity. Auger 308 has a continuous helical cavity 310 in which ink sticks 100 are slidably communicated away from the melting assembly 128 in the O' direction. Since auger engagement features on an ink stick may somewhat captivate the stick to the auger, abutting sticks subsequently inserted to a feed channel must be addressed. Engagement features may allow a slip condition in the feed direction to overcome this issue. Alternatively, the whole volume of sticks in a feed channel may be retracted and positioned such that an added stick is adjacent the last stick in the feed column. There are other methods of employing an auger driven retraction. One method of implementing an auger retract function would be to have a short auger placed near the melt region and nominally outboard of contact with the interface feature of an ink stick. When the action of retraction is desired, the auger would be turned, causing it to rotate, translate and move into engagement with the ink stick retraction feature or features. This combination of motions, which may be enabled by gears and/or cams, would ensure engagement and retraction regardless of the location of retraction features relative to the trailing end of the leading ink stick. Should the ink stick be melted to such a short length that no engagement occurs, the stick or push block behind the partial leading ink stick would be retracted, resulting in feed force removal and post heating melt reduction.

Figure 8A:
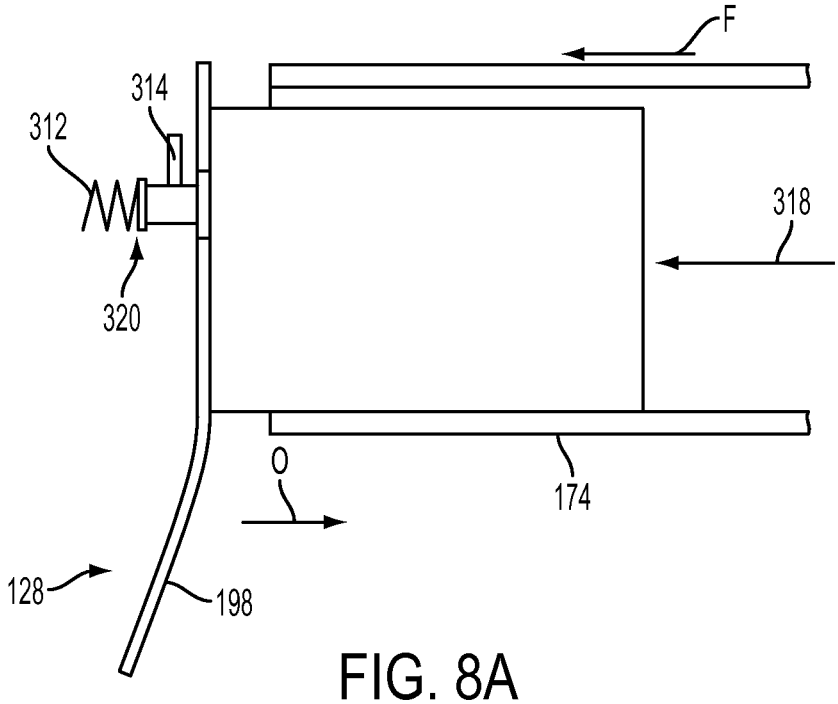
FIG. 8A is a schematic diagram of a pusher assembly in a phase change ink handling assembly in a first position according to a group of embodiments.
Figure 8B:
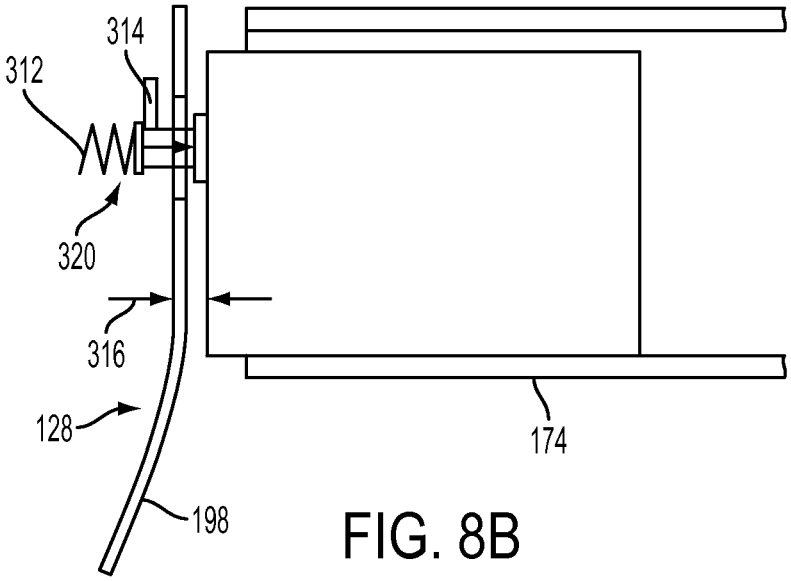
FIG. 8B is a schematic diagram of a pusher assembly in a phase change ink handling assembly in a second position according to a group of embodiments.

In one embodiment, and in reference to FIGS. 8A and 8B, a pusher assembly can be used to retract the leading ink stick 100C. Since the desired separation between the leading ink stick 100C and the melting plate(s) is small, on the order of one millimeter, pusher assembly 320 disposed on or proximate to the melting plate(s) 198 can be used to achieve the desired separation. Using pusher assemblies 320 may eliminate the need to reverse a drive mechanism. In this embodiment, pusher assemblies 320 continuously apply forces to the leading ink stick 100C in the O direction. The pusher may exert a force generated by biasing member 312, e.g., a spring. A controller coupled to a drive mechanism, e.g., drive mechanism 142 of FIG. 1, detects when the heater is powered and causes the ink sticks 100 to move in the in the F direction, by exerting a force against the ink stick as indicated by arrow 318. The force applied by the drive mechanism overcomes biasing members 312 and thereby compresses them allowing the leading edge 118 of the leading ink stick to approach or contact the melting plate(s) 198. When the controller detects termination of power to the heater, it signals the drive mechanism to stop applying force onto the ink sticks in the direction of arrow 318. In response thereto, the drive mechanism disengages from the ink sticks, as shown in FIG. 8B. The pusher assemblies 320 displace the leading edge 118 of the leading ink stick in the O direction to achieve the desired separation 316 of the ink stick. The limit as to how far the melting plate 198 is separated from the ink stick is determined by the spacing between stops 314 and the biasing members 312. The smaller mass of the pushers in contact with the ink sticks are unable to sustain a melt temperature so further melting is rapidly suspended. Many variations of the pusher may be implemented. If a column of ink sticks is urged to the melt plate with a spring or urging device of some type, the urging force can be suspended or as appropriate, retracted so that the pusher is able to push the ink stick away from the melt plate.

Figure 9A:
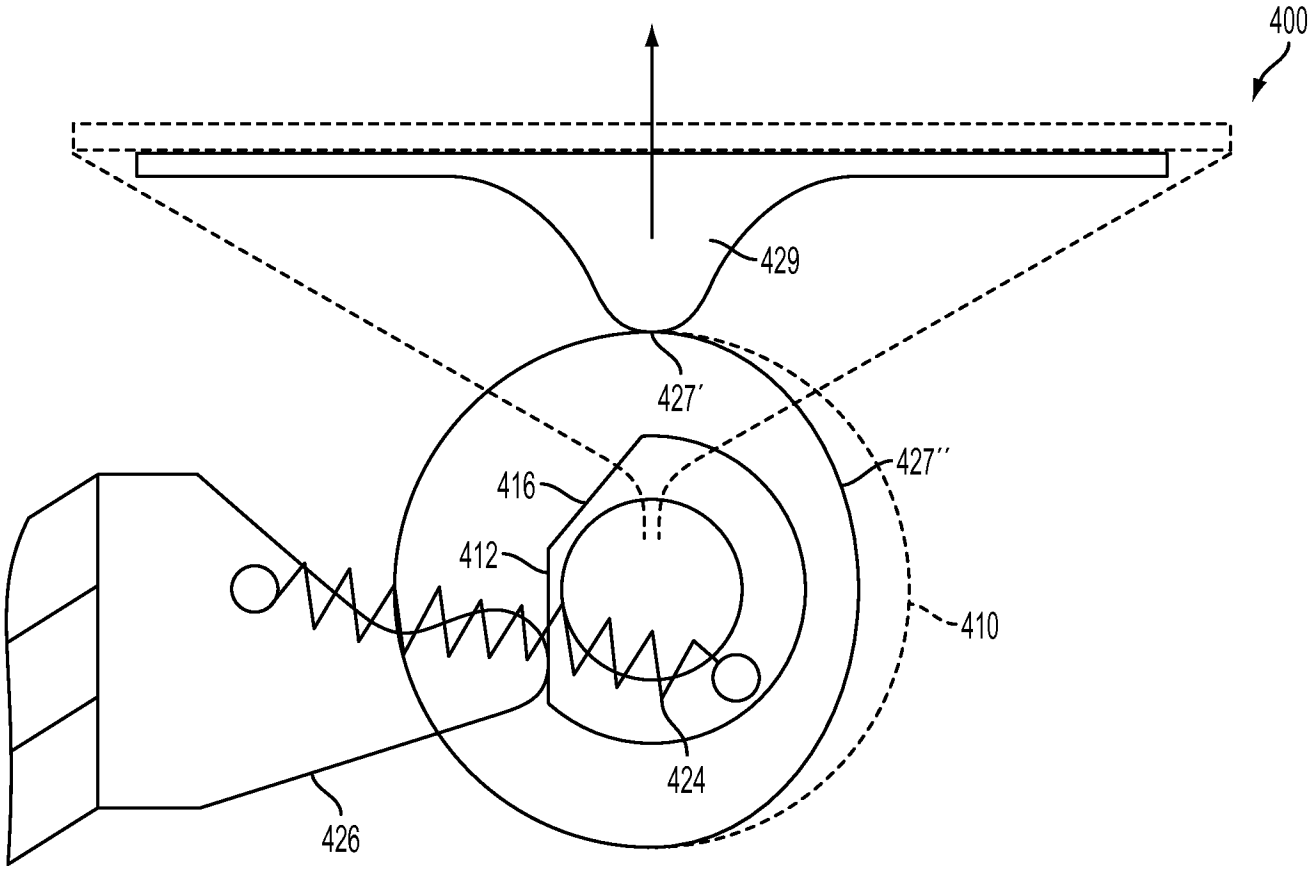
FIG. 9A is a top view schematic diagram of a bistable cam assembly in a phase change ink handling assembly in a first position according to a group of embodiments.
Figure 9B:
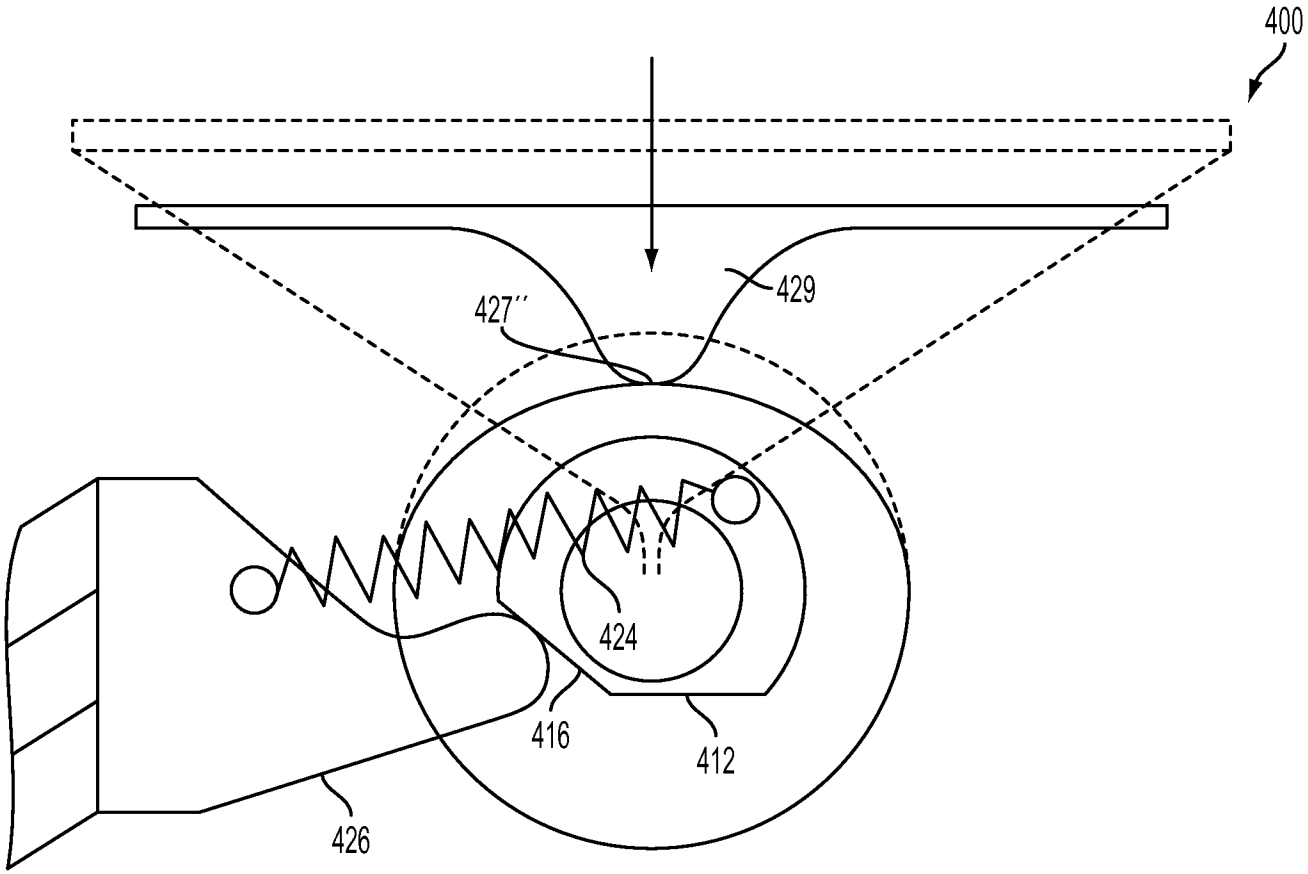
FIG. 9B is a top view schematic diagram of a bistable cam assembly in a phase change ink handling assembly in a second position according to a group of embodiments.

In another group of embodiments the heat source is separated from the leading ink stick by retracting the entire melting assembly 128 or by retracting the heater from the melting plate(s) 198. In one embodiment, the heater can be retracted from the melt plate(s) 198. An exemplary embodiment is provided in FIGS. 9A and 9B, wherein a bi-stable spring loaded cam assembly 400 is shown. A cam wheel 410 has two actuating surfaces 412 and 416. The actuating surfaces 412 and 416 are different radial distances from the shaft providing the first and second heater translation positions. The triangular dashed lines indicate a drip plate that advantageously guides the melted ink toward a corresponding reservoir. Attaining the optimal cam rotation angle is enabled by phased cam surfaces contacting a rotation limit or stop 426. Referring to FIG. 9A, the actuating surface 412 causes a first cam lobe 427' to push a cam follower 429 upward thereby pushing a heater to make contact with the melt plate. Alternatively, an entire heater/melt plate assembly can be pushed by cam follower 429 into the melting position as a result of actuating surface 412 coming in contact with cam stop 426. A second cam lobe 427" is shown in FIG. 9B. A phantom arcuate surface is shown near the cam lobe 427 to better visualize the cam lobe 427" with respect to the cam wheel 410. Rotation of cam wheel 410 causes the second actuating surface 416 to make contact with the cam stop. In this position, cam follower 429 following the second cam lobe 427" moves downwardly and separates the heater from the melt plate. Alternatively, the entire heater/melt plate assembly can move downwardly to cease further melting as a result of actuating surface 416 coming in contact with cam stop 426. This retraction is accomplished by way of biasing members (not shown) which bias the heater away from the melt plate 198 and toward the cam wheel 410. These biasing members are well known by those skilled in the art as are actuator mechanisms, such as those driven by solenoids and motors. A spring 424 holds the cam wheel 410 in one of the bi-stable positions as the cam wheel 410 is rotated 90° in the illustrated example. In another embodiment, the heater or heater plate would include heated features that engage or pass through a complementarily configured melt plate. Retracting the heater plate would not then require any other ink stop or retract function as the ink stick would be held by the melt plate.

Figure 10A:
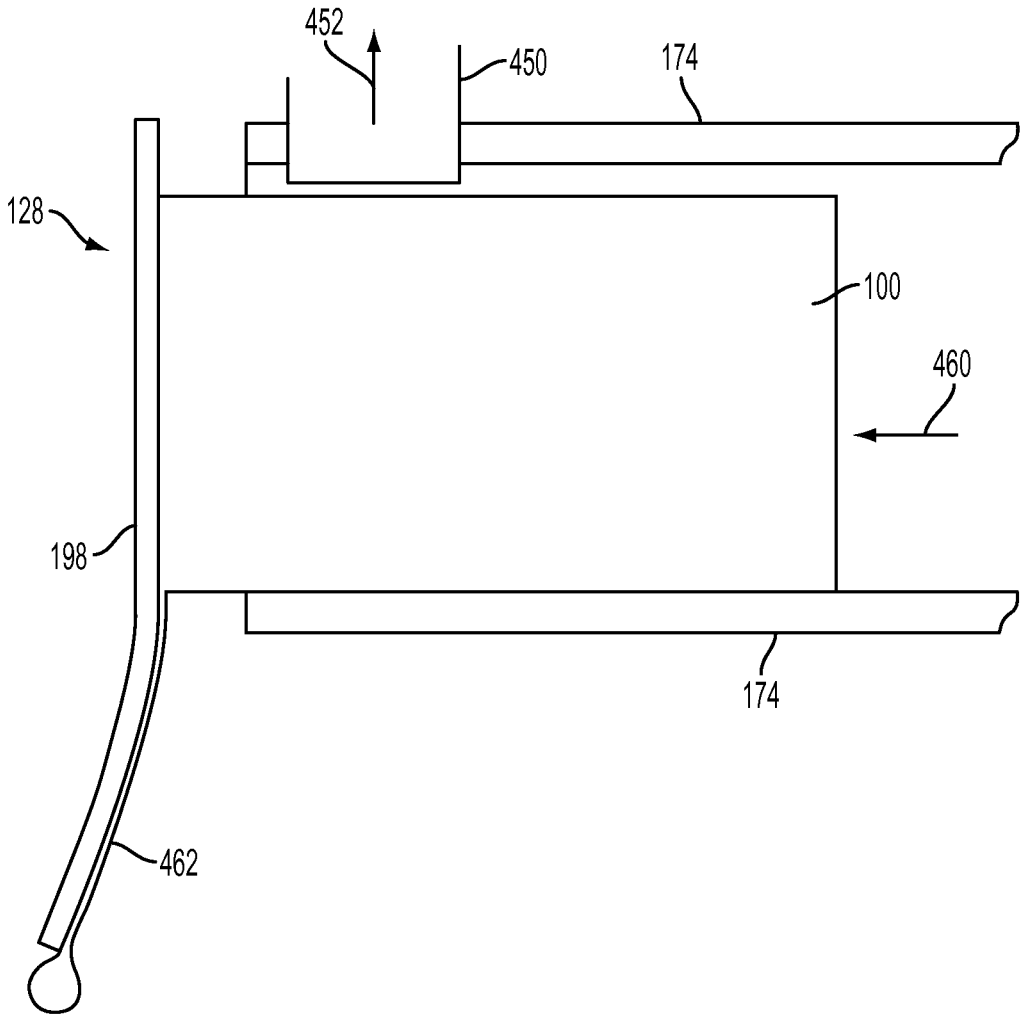
FIG. 10A is a side view schematic diagram of a feed inhibiting feature in a phase change ink handling assembly in a first position according to a group of embodiments.
Figure 10B:
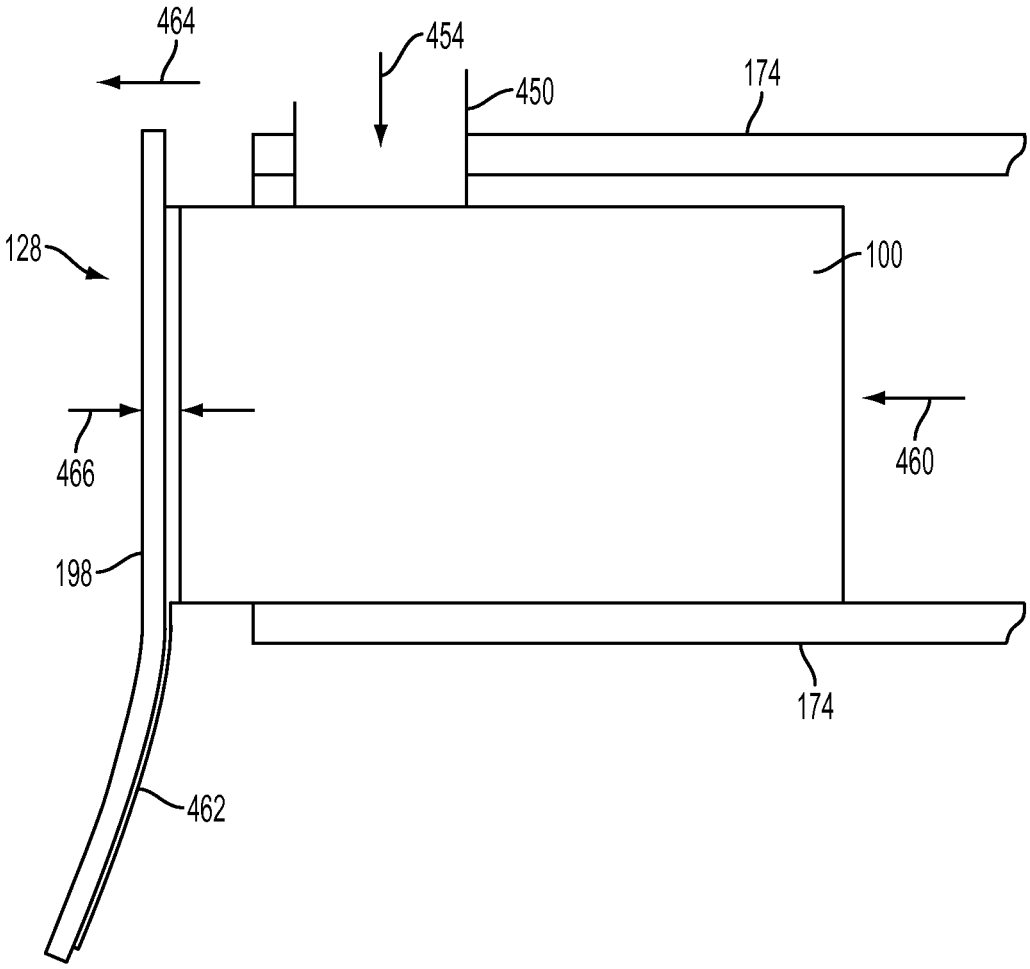
FIG. 10B is a side view schematic diagram of a feed inhibiting feature in a phase change ink handling assembly in a second position according to a group of embodiments.

In another embodiment, the entire melting assembly 128 can be retracted from a leading ink stick in a feed channel. This embodiment is shown in FIGS. 10A and 10B. Referring to FIG. 10A, a biasing feature 460, e.g., a spring or gravity, urges ink stick 100 toward the melt plate 198. The ink stick is contained in constraining surface 174. A stop or a feed inhibiting feature 450 is configured to limit the progressive movement of the ink stick 100. In normal operation while the feed inhibiting feature is disengaged from the ink stick as indicated by arrow 452, the ink melts as indicated by reference numeral 462. Referring to FIG. 10B, when the melting assembly 128 is pulled away from the leading ink stick to stop the melting process, as indicated by arrow 464, the feed inhibiting feature 450, engages the ink stick 100 and holds it back, as indicated by arrow 454, thereby allowing the melting assembly 128 to retract from the ink stick 100. A gap 466 is thereby generated to cease the melting process. A similar mechanism such as a bi-stable spring loaded cam assembly discussed above can be used to retract the entire melting assembly.

In another group of embodiments only further advancement of the leading ink stick is prevented. In one embodiment, a mechanical actuator may be urging the ink stick towards the melt plate. In this embodiment preventing further advancement of the ink stick is accomplished by disengaging the mechanical actuator. The disengagement of the mechanical actuator may include disengaging or retracting a drive coupling or retracting a displaceable member. Both of these schemes only prevent further progression of the ink stick into the melt plate.

One exemplary embodiment of this group is shown in FIGS. 10A and 10B. Referring to these figures and in reference to this group of embodiments, the melt assembly 128 remains stationary. That is, no active retracting mechanisms are used to separate the heat source form the leading ink stick. In this group of embodiments, a very limited volume of ink may be melted after the ink stick feed force is removed or overcome. This limited volume of solid ink that is melted in a receding melt front provides a gap 466 between the ink stick and the melt plate. In these embodiments the ink stick is not retracted from a stationary melting assembly nor is the melting assembly retracted from a stationary ink stick. Systems that use these embodiments must be designed to accommodate a small amount of molten ink as the ink melt front recedes from a melt plate that is simultaneously cooling after the melting assembly is powered off. The feed inhibiting feature 450 prevents further advancement of the leading ink stick toward the melting assembly by providing a force to counter the urging force of the biasing feature 460 acting upon the ink stick. This counter acting force may be realized by way of a clamp or any other type of high friction contact against the ink stick sufficient to overcome the feeding force exerted on the ink stick. In one embodiment, such as a near horizontal or upward sloped feed path, simply removing the feed force may enable the release of the mechanical urging against the ink stick sufficiently to provide the necessary separation for cessation of melting. The urging force applied to one or more ink sticks toward or into a melt plate may also offer the option to arrest post heater turn off melting by disengaging that force, such as by drive disengagement, retracting an auger, by back-driving a mechanized pusher, or to retract a spring pusher or relieving the spring force. The leading end of the ink stick becomes a melt front as it impinges on the melt plate and eliminating the urging force on the ink toward the melt plate allows the melt front to recede so that melting stops. Also, in another embodiment, the ink stick feed may be halted and the desired separation between the leading ink stick and the melt plate(s) achieved by pivoting the leading stick away from the melt plate(s). In this embodiment, even if an edge of the melt front remained in contact with or proximate to the melt plate(s), the amount of ink that is melted would be negligible.

All methods of preventing feed motion of the ink into the melt plate accomplish melt cessation much more effectively than simply removing power from the melt plate heater. A thermal gradient exists across a thickness of molten ink that was melted by making contact with a melt plate. The front of the ink stick fed into the heated plate is below the melt temperature so the molten material adjacent that front is only marginally warmer. Due to the endothermic latent heat energy required to melt the ink, melting may cease quite rapidly if the molten film between melt plate and ink stick melt becomes thicker and imparts less heat energy into the solid ink. With no feed force being applied, the melt surface of the ink stick is stationary and molten ink that develops from the residual heat is not squeezed from between the ink stick and melt plate and thus is a thermal isolator which becomes a thermal insulator as the film thickness increases. Additionally, ink that does escape may be replaced by an air gap so that thermal energy remaining within the melt plate assembly is even further restricted from transferring to the ink stick. The solid front of the ink stick is thus separated from the melt plate, establishing the gap or distance from the melt plate required to stop the melt process regardless of the presence or consistency of molten ink within that gap. This phenomenon was discovered in conjunction with ink feed jams that prevented the ink stick from continuing to feed into the melt plate during a melt cycle. The foregoing description thus becomes a qualifying definition of "distance" or "separation" of the heater plate and ink stick for the present concept of rapid melt cessation. Understanding this functionality is especially important in consideration of a possible scenario where some heat is maintained in the melt plate intentionally where the ink stick is in contact with the melt plate so that initiation of melt can begin quickly when full melt power is applied. Thus maintaining an elevated temperature at the ink melt front and/or continuous heat transfer to the ink below a melt threshold may be desired.

Figure 11A:
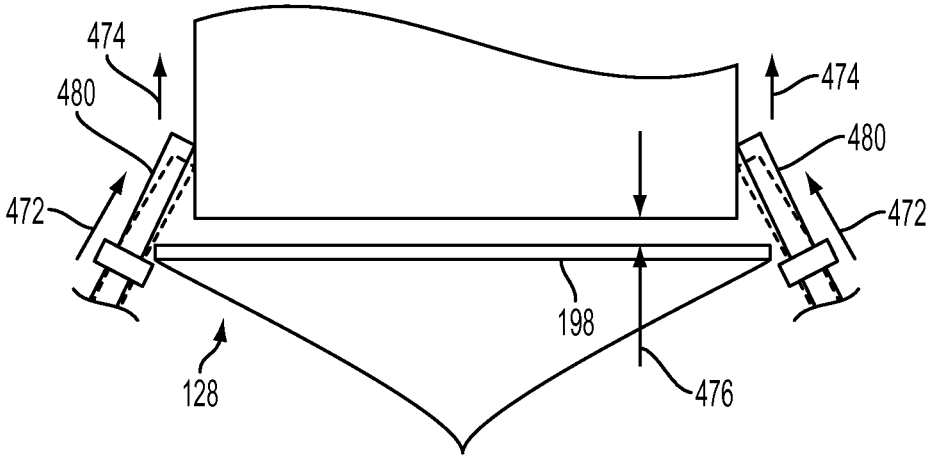
FIG. 11A is a schematic diagram of a retractor feature in a phase change ink handling assembly in a first position according to a group of embodiments.
Figure 11B:
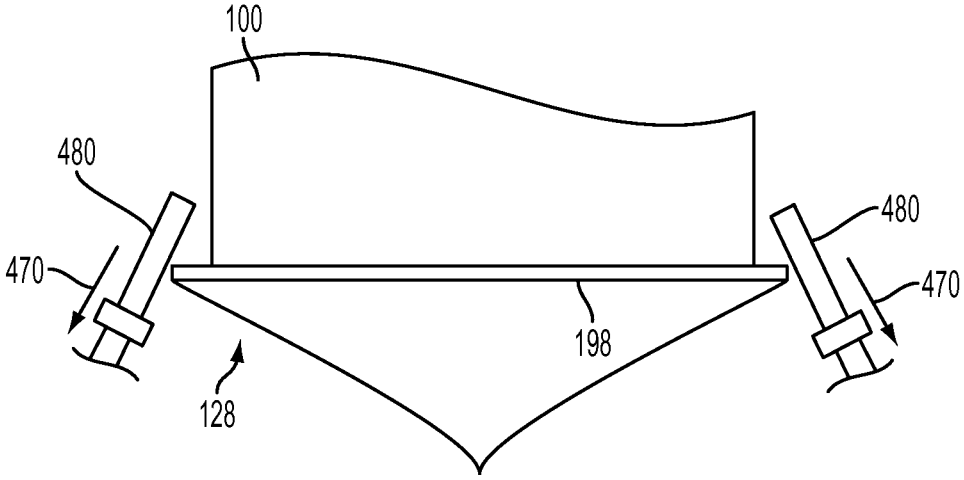
FIG. 11B is a schematic diagram of a retractor feature in a phase change ink handling assembly in a second position according to a group of embodiments.

In one embodiment, a retractor can be used. Referring to FIGS. 11A and 11B, an exemplary embodiment of the retractor is shown. The retractor can have two positions. In a first position, shown in FIG. 11A, the retractor 480 is engaged with the ink stick 100. To this end, the retractor 480 is moved in an upward direction as indicated by arrows 472, and thereby causing the ink stick 100 to move away from the melting assembly 128 as indicated by arrows 474. Movement of the ink stick 100 provides a gap 476 between the ink stick and the melt plate to accomplish melt cessation. In a second position, shown in FIG. 11B, the retractor 480 is decoupled from the ink stick 100, by moving the retractor 480 in the direction of arrows 470, and thereby allowing the ink stick to melt. The triangular feature under the melt plate 198 indicates a drip plate that advantageously guides the melted ink toward a reservoir.

Alternatively, the retractor can be configured to move between a first position which engages a second ink stick having a leading edge that is not in contact with or proximate to the melting assembly; and a second position which is out of engagement with the second ink stick. In this embodiment retracting the second ink stick may cause some retraction of the leading ink stick but at the least removes the urging force. In either of these embodiments, the controller, in response to termination of power to the heater, moves the retractor between the second and the first positions and thereby moves the ink stick away from the melt plate(s) when the retractor is in the first position. A clamp or any other high friction device that is coupled to the controller can be used to grip the leading ink stick, or the second ink stick in accordance with the alternative embodiment, when the retractor is in the first position. The controller can also signal the clamp to release the ink stick when the retractor is in the second position.

In another embodiment a stop is provided. The stop is configured to move between a first position that engages the leading ink stick having the leading edge 118 either in contact with or proximate to the melt plate(s) 198, and a second position out of engagement with the ink sticks in the feed channel 130. In this embodiment the controller is coupled to the stop to move the stop between the first position and the second position. The stop may take various forms, as example a tapered wedge which, when extended, is able to be interposed between the stick and the melt plate. A controller may be coupled to the stop through an actuator. The controller generates a signal that operates the actuator to move the stop between the first position and the second position. In combination with this embodiment, the controller may be optionally coupled to the heater through another actuator and is configured to generate a signal to the heater actuator that moves the heater and the melt plates(s) 198 away from the ink stick in response to the stop being moved to the second position.

In one embodiment the heater and the melt plate coupled to the heater may be preheated prior to leading ink stick coming in contact with the melt plate. This preheat stage, provides a faster response time, i.e., less time to initiate the ink melt process. The ink stick motion in this embodiment may be independent of the heater control, at least in the forward feeding direction, while retraction of the ink stick could still be in response to termination of power to the heater. Also, the timing of heater power control relative to any ink stick feed influence, such as the stop, retract and separations described above, may be simultaneous, sequenced or independently and/or variably controlled in various implementations. In certain embodiments, further feed of ink sticks may be prevented prior to removing heater power in response to a reservoir fill level sensor. In another embodiment, software algorithms executed by a controller may anticipate a time when the ink reservoir reach a full state, thereby powering off the heater and implementing any of the above described schemes in response to the anticipated time.

In operation, the controller of a solid ink printer is configured with programmed instructions to monitor the heaters for the melting plates in the printer and to separate the melting plates and the ink stick in response to the detection of power to a heater being terminated. In one group of embodiments, the controller actively separates the leading ink stick and the heat source by retracting the leading ink stick from a stationary heat source or by retracting the heat source from a fixed in-place leading ink stick. In another group of embodiment, the controller only prevents further advancement of the leading ink stick.

It will be appreciated that various of the above-disclosed and other features, and functions, or alternatives thereof, may be desirably combined into many other different systems or applications. A few of the alternative implementations may comprise various combinations of the methods and techniques described. Various presently unforeseen or unanticipated alternatives, modifications, variations, or improvements therein may be subsequently made by those skilled in the art, which are also intended to be encompassed by the following claims.

The invention claimed is:

1. A method for controlling application of heat with a melt plate to an ink stick in a solid ink imaging device comprising:

monitoring termination of electrical power to a heater that heats a melt plate for melting solid ink sticks in a solid ink printer; and moving one of the heater and a solid ink stick contacting the melt plate to separate the heater and the solid ink stick by a distance that arrests melting of a leading edge of the solid ink stick.

2. The method of claim 1, the movement of one of the solid ink stick and the heater further comprising:

moving the leading edge of the ink stick away from the melt plate.

3. The method of claim 2, the movement of the leading edge of the solid ink stick from the melt plate further comprising:

reversing a conveyor that urges the ink stick against the melt plate.

4. The method of claim 2, the movement of the leading edge of the solid ink stick from the melt plate further comprising:

moving a second ink stick coupled to the ink stick away from the melt plate.

5. The method of claim 2, the movement of the leading edge of the solid ink stick from the melt plate further comprising:

pushing against the ink stick to move the ink stick away from the melt plate.

6. The method of claim 1, the movement of the one of the ink stick and the heater further comprising:

moving the heater away from the melt plate.

7. The method of claim 6 further comprising:

moving the melt plate away from the ink stick.

8. A system for controlling application of heat with a melt plate to an ink stick in a solid ink imaging device comprising:

a melt plate;

a heater configured to heat the melt plate to a temperature sufficient to melt solid ink;

a feed channel configured to direct solid ink sticks towards the melt plate to enable a leading edge of a solid ink stick to be melted by the heated melt plate; and a controller configured to move one of the heater and the leading edge of the ink stick by a distance that arrests melting of the solid ink stick.

9. The system of claim 8 further comprising:

a retractor operatively connected to the controller and configured to move between a first position that allows engagement of an ink stick leading edge and a melt plate and a second position that disengages the ink stick from the melt plate; and the controller being configured to selectively move the retractor to the first position and to the second position.

10. The system of claim 8 further comprising:

a conveyor proximate the feed channel to urge ink sticks through the feed channel towards the melt plate; and the controller being operatively connected to the conveyor and being configured to reverse the conveyor to separate the leading edge of the ink stick away from the melt plate.

11. The system of claim 8 further comprising:

a retractor operatively connected to the controller and configured to move between a first position that engages a second ink stick in the feed channel having a leading edge that does not contact the melt plate and a second position out of engagement with the second ink stick; and the controller being configured to selectively move the retractor between the first and the second positions.

12. The system of claim 8, the controller being operatively connected to the heater and being further configured to:

move the heater between a first position and a second position selectively, the heater being able to heat the melt plate when located at the first position and the heater being separated from the melt plate when located at the second position to enable the melt plate to cool.

* * * * *